United States Patent [19]

Johnson

[11] 4,391,449

[45] Jul. 5, 1983

[54] BOARD GAME

[76] Inventor: Robert L. Johnson, 3655 Pruneridge, Apt. 261, Santa Clara, Calif. 95051

[21] Appl. No.: 271,626

[22] Filed: Jun. 8, 1981

[51] Int. Cl.[3] ..... A63F 3/02

[52] U.S. Cl. ..... 273/260

[58] Field of Search ..... 273/258, 260, 263, 264, 273/287, 291

[56] References Cited

U.S. PATENT DOCUMENTS

| | | | |
|---|---|---|---|
| D. 173,244 | 10/1954 | Shalkhauser | D21/34 X |
| D. 197,566 | 2/1964 | Ward | D21/24 |
| 809,502 | 1/1908 | Hale | 273/258 X |
| 949,007 | 2/1910 | Schittner | 273/263 |
| 1,131,603 | 3/1915 | Dueberg | 273/263 |
| 3,190,655 | 6/1965 | Louie | 273/291 X |
| 4,288,078 | 9/1981 | Lugo | 273/264 |

FOREIGN PATENT DOCUMENTS

| | | | |
|---|---|---|---|
| 423609 | 2/1935 | United Kingdom | 273/258 |

*Primary Examiner*—Richard C. Pinkham
*Assistant Examiner*—Scott L. Brown
*Attorney, Agent, or Firm*—Paul L. Hickman

[57] ABSTRACT

A board game characterized by a playing surface provided with indicia dividing the surface into 64 squares or spaces, and indicia within each space including a positioning mark and eight directive lines radiating outwardly from the positioning mark. The directive lines are either inverting directives or non-inverting directives. The game also includes disk shaped playing pieces having color or shade differentiated sides. The pieces are placed upon the positioning marks of the playing surface and moved along the directive lines in an attempt to capture or trap the opponent's pieces. Movement along an inverting directive line causes the pieces to be turned over to modify their power to capture opponent's pieces.

11 Claims, 5 Drawing Figures

BOARD GAME

BACKGROUND OF THE INVENTION

1. Field of the Invention

This invention relates generally to games and more particularly to board game such as checkers or chess.

2. Description of the Prior Art

There are a great many board games in existance, both patented and unpatented. Two of the most popular board games around are checkers and chess.

Checkers is played on a board divided into 64 squares of alternating colors and with a set of red pieces for a first player and a set of black pieces for a second player. The players move their pieces across the board in an attempt to capture or trap all of the other player's pieces.

Chess is played on a board that is identical to the checkers board described above. The pieces in a chess game have varying powers and capabilities, which allows complexities and subtleties in a chess game that are lacking in the simpler game of checkers. Unfortunately, many people find chess to be too comlex a game to be played for casual enjoyment.

What the prior art fails to disclose, then, is a board game that is easier to play than chess, yet which has more complexity and subtleties than a checkers game.

SUMMARY OF THE INVENTION

It is the major object of this invention to provide a board game that is enjoyable, easy to learn, and challenging to play.

It is a further object of this invention to provide a board game as described above which futher is relatively inexpensive to manufacture.

Briefly, the invention includes a board having a playing surface, a number of first player pieces, and a number of second player pieces distinguishable from the first player pieces. The playing surface is divided into sixty-four squares or spaces by a plurality of horizontal and vertical lines. Centered within each of the sixty-four spaces is a circular positioning mark and eight directive lines radiating from the positioning mark to the four sides of the space. Four of the directive lines go to the corners of the spaces, and the other four directive lines bisect the sides of the spaces. The directives are either inverting directives or non-inverting directives.

The player pieces are preferably disk shaped and have easily distinguishable sides. They are placed upon the positioning marks of the board in checker-board fashion and can move along the directive lines either forwards or sidewards. When they cross an inverting directive the pieces are turned over. Pieces of one player can diagonally capture pieces of another player by direct substitution, but only if the upper face of the pieces correspond to one another.

Some of the player pieces are provided with special insignia. These special pieces, which are earned by moving a regular piece all the way across the playing board, have enhanced powers of movement.

The major advantage of this game is that it is easy to learn to play, and yet is quite challenging. For each player there are only two types of pieces (i.e. the plain and the insigniated pieces) with easily understandable rules governing their movements. The complexity is added by the directives on the playing surface which modify their ability to capture opponent's pieces. The board and the two sided pieces add the complexity to the game and, since they are always in view, there is no difficult memorization or visualization required of the players.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
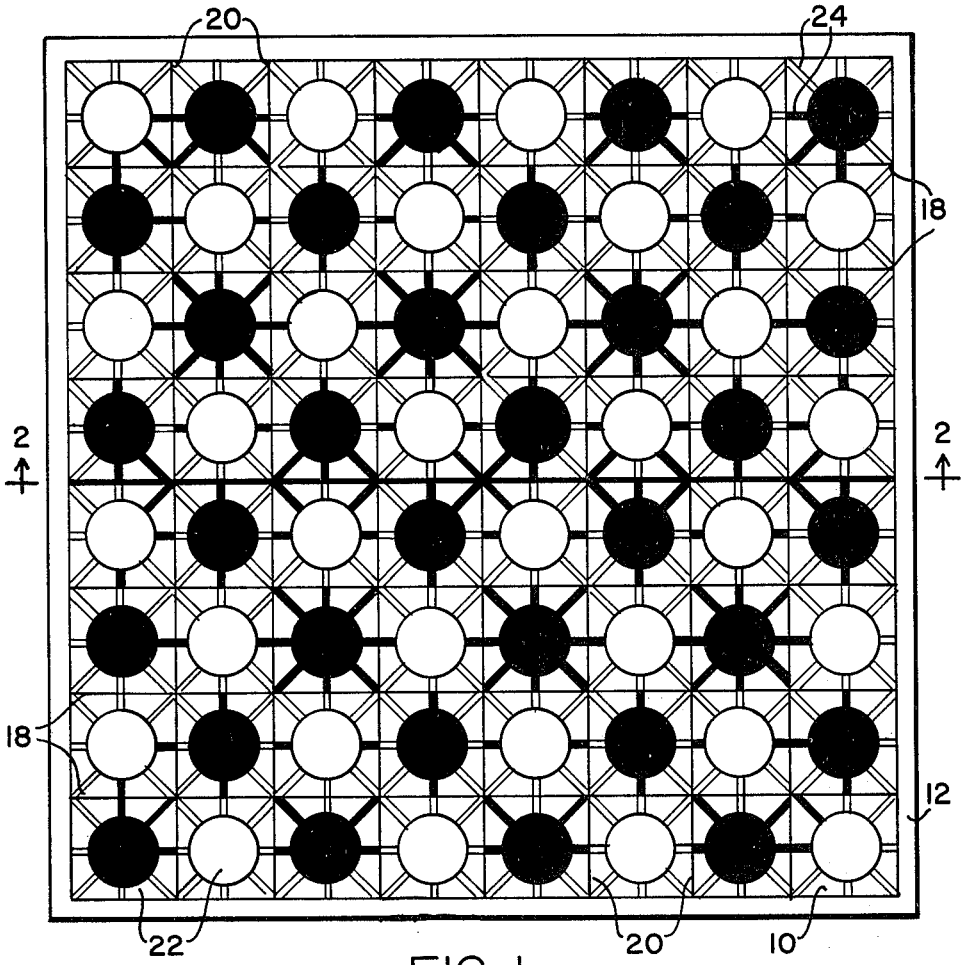
FIG. 1 is a is a top plan view of a board game in accordance with the present invention.
Figure 2:
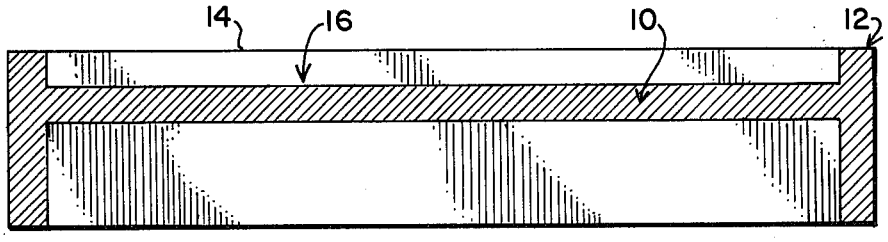
FIG. 2 is a cross-sectional view taken along line 2—2 of FIG. 1.

Referring to FIGS. 1 and 2, the game board of the present invention includes a board portion 10 and a frame portion 12 surrounding the periphery of the board portion. The board portion is substantially square and is recessed downwardly from the upper edge 14 of the frame. The game board is preferably constructed from a transparent or translucent thermoplastic, although it can also be constructed from any other suitable material.

The board portion 10 includes a playing surface 16 provided with the indicia shown in FIG. 1. Part of the indicia, including horizontal lines such as those shown at 18 and vertical lines such as those shown at 20, divide the playing surface into sixty-four equal, four-sided spaces. The spaces have four sides defined by segments of lines 18 and 20 and, in fact, are usually substantially square.

The indicia also includes markings within each of the sixty-four spaces including positioning marks such as those shown at 22, and directive lines such as those shown at 24. The positioning marks 22 are circular and are centered within each one of the sixty-four spaces. One half of the positioning marks are colored a first color, such as white, and the other half of the positioning marks are colored a second color, such as black. The black and white positioning marks are arranged on the playing surface in a checker-board pattern.

There are eight directive lines 24 within each one of the spaces. Four of the directive lines radially extend from the positioning mark to the corners of the space, and the other four directive lines radially extend from the positioning mark and bisect the four sides of the space.

The directive lines are of one of two types, as indicated by the shaded and unshaded lines in the figure. The shaded lines are inverting directives and the unshaded lines are non-inverting directives. A preferred embodiment of this invention has the non-inverting directives colored yellow and the inverting directives colored black.

The dimension of the board is preferably 12″×12″, and the outer frame is preferably ¾″ in height. The lines 18 and 20 are preferably black and about ⅛″ wide. The board portion 10 is preferably dropped about ¼" below upper edge 14.

Figure 3:
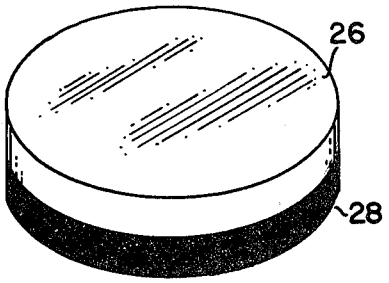
FIG. 3 is a perspective view of a playing piece of a first player.

In FIG. 3 a playing piece of a first player is shown to be substantially disk shaped and includes an upper disk portion 26 and a lower disk portion 28. The two sides of the disk are distinguished from one another preferably by differentially tinting or shading the sides. In this figure upper portion 26 is white and lower portion 28 is black.

Figure 4:
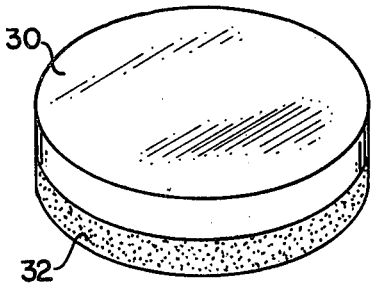
FIG. 4 is a perspective view of a playing piece of a second player.

In FIG. 4 a playing piece of a second player is also shown to be substantially disk shaped and to include an upper disk portion 30 (which is colored white) and a lower disk portion 32 (which is colored gray). Side 32 must be sufficiently tinted or shaded to differentiate that side from side 30, but it must also be sufficiently different in coloration than side 28 of the first player's pieces so that the pieces of the two players can be told apart.

There are twelve of the pieces shown in FIG. 3 provided for the first player, and twelve of the pieces shown in FIG. 4 provided for the second player. Each player is also provided with six extra pieces provided with a special insignia.

Figure 5A:
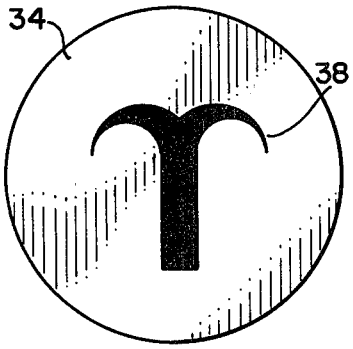
FIG. 5*a* is a top plan view of an insigniated playing piece of the second player.
Figure 5B:
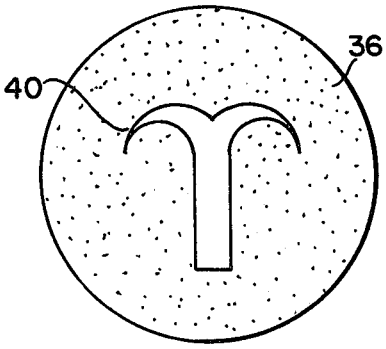
FIG. 5*b* is a bottom plan view of an insigniated playing piece of the second player.

In FIGS. 5*a* and 5*b* one of the insigniated pieces for the second player is shown in top plan and bottom plan view, respectively. The upper disk portion 34 is the same color, shade, configuration and size as the upper disk portion 30 of FIG. 4, but is provided with the 'emperor' insignia 38. The lower disk portion 36 is the same color, shade, configuration and size as the lower disk portion 32 of FIG. 4, but is provided with the 'emperor' insignia 40. Likewise, the insigniated pieces for the first player are identical to the piece shown in FIG. 3, but are provided with 'emperor' insignias on the top and bottom surface.

While the size of the pieces can obviously vary, they preferably are 1-1/16" in diameter and ⅜" thick. The insignia is preferably ½" wide and ⅜" tall.

The game is played with the two players seated on opposite sides of the board. The row nearest each player is known as that player's 'emperor' zone. The twelve regular pieces of the players are placed upon the black positioning marks in the first three rows of their respective sides.

The object of the game is to capture or trap all of the other player's pieces. This object is accomplished by moving pieces across the board along any forward or sideward directive and by capturing the opponent's pieces by moving along a forward diagonal. The regular pieces can not move in a horizontal direction more than three consecutive times.

Everytime a piece moves along an inverting directive it is turned over so that its opposite side is showing. An opponent's piece can only be captured if its upper face or side corresponds to that of the capturing piece. For example, if the piece of FIG. 4 has side 30 facing up then the piece of FIG. 3 can only capture it if side 26 is facing up. Conversely, if the piece of FIG. 3, has side 28 facing up the piece of FIG. 4 can only capture it if side 32 is facing up.

If a player's piece reaches his opponent's 'emperor' zone one of the insigniated pieces is substituted for it. The insigniated piece has additional powers of movement, including unlimited movement along the non-inverting directives and unrestricted directional movement.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A board game comprising:

a playing surface provided with indicia including:

(A) a first plurality of spaced apart parallel lines;

(B) a second plurality of spaced apart parallel lines substantially perpendicular to said first plurality of lines, whereby said playing surface is divided into a number of four-sided spaces;

(C) a plurality of positioning marks located, one each, within each of said spaces;

(D) a plurality of directive lines located, eight each, within each of said spaces such that, within each space, four of said directive lines extend from said positioning mark to the corners of said space, and the other four of said directive lines extend from said positioning mark to the four sides of said space;

(E) directive line distinguishing means wherein a first group of said plurality of directive lines have a first visual appearance, and a second group of said plurality of directive lines have a second visual appearance;

(F) a plurality of first player pieces, each of which has a first side having a first distinguishing characteristic, and a second side having a second distinguishing characteristic; and (G) a plurality of second player pieces, each of which has a first side having a first distinguishing characteristic, and a second side having a second distinguishing characteristic.

2. A board game as recited in claim 1 wherein each of said plurality of positioning marks is substantially centered within one of said plurality of spaces, and wherein said directive lines extend substantially radially from said positioning marks to said corners and sides of said spaces.

3. A board game as recited in claim 2 further comprising a board having a flat, planar surface at least part of which is said playing surface.

4. A board game as recited in claim 3 wherein one half of said plurality of positioning marks are firstly characterized, and wherein the other half of said plurality of positioning marks are secondly characterized; said firstly characterized positioning marks and said secondly characterized positioning marks being arranged in a checker-board pattern on said playing surface.

5. A board game as recited in claim 4 wherein said four-sided spaces are substantially square and wherein said positioning marks are substantially round.

6. A board game as recited in claim 5 wherein said first visual appearance of said first group comprises a first color and wherein said second visual appearance of said second group comprises a second color.

7. A board game as recited in claim 6 wherein said playing surface is divided into sixty-four spaces by said first plurality of lines and said second plurality of lines.

8. A board game as recited in claim 6 wherein said board is surrounded by a frame.

9. A board game as recited in claim 1 wherein at least one of said first player pieces is marked with a special insignia on both said first side and said second side, and wherein at least one of said second player pieces is marked with a special insignia on both said first side and said second side.

10. A board game as recited in claim 9 wherein said first player pieces and said second player pieces are disk shaped, the flat faces of which define said first sides and said second sides, and wherein said first distinguishing characteristic and said second distinguishing characteristic comprise visually distinguishable tints or shades associated with said first sides and said second sides.

11. A board game as recited in claim 10 wherein said first distinguishing characteristic of said first player pieces and said first distinguishing characteristic of said second player pieces are the same, and wherein said second distinguishing characteristic of said first player pieces and said second distinguishing characteristic of said second player pieces are different.

* * * * *